US007494455B2

(12) United States Patent
Held

(10) Patent No.: US 7,494,455 B2
(45) Date of Patent: Feb. 24, 2009

(54) CYLINDER FOR PROCESSING FLAT MATERIAL

(75) Inventor: Michael Held, Heuchelheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 92 days.

(21) Appl. No.: 11/587,582

(22) PCT Filed: Apr. 13, 2005

(86) PCT No.: PCT/EP2005/051635

§ 371 (c)(1),
(2), (4) Date: Oct. 25, 2006

(87) PCT Pub. No.: WO2005/102890

PCT Pub. Date: Nov. 3, 2005

(65) Prior Publication Data

US 2007/0214975 A1 Sep. 20, 2007

(30) Foreign Application Priority Data

Apr. 26, 2004 (DE) ..... 10 2004 020 304

(51) Int. Cl.
*B31F 1/08* (2006.01)

(52) U.S. Cl. ..... 493/424; 493/428; 493/432

(58) Field of Classification Search ..... 493/424, 493/428, 432, 445; 270/50, 42, 60, 38, 11
See application file for complete search history.

(56) References Cited

U.S. PATENT DOCUMENTS 3,180,007 A * 4/1965 Gartz ..... 492/38
3,521,878 A * 7/1970 Bolza-Schunemann ..... 493/429
3,787,041 A * 1/1974 Hertrich ..... 493/359
3,921,968 A * 11/1975 Thomas et al. ..... 270/60
4,094,499 A 6/1978 Thomas (Continued)

FOREIGN PATENT DOCUMENTS

DE 38 28 372 A1 2/1990

(Continued)

*Primary Examiner*—Sameh H. Tawfik
(74) *Attorney, Agent, or Firm*—Jones, Tullar & Cooper, PC

(57) ABSTRACT

A cylinder, having a cylindrical body which is rotatable about a cylinder axis of rotation, is usable to process flat material. At least one group of a plurality of tools are distributed around the periphery of the cylinder body in a homogeneous manner. These tools are able to perform a working movement with respect to the cylindrical body and are coupled to a control device which effects that working movement. A first cam plate is traced by the control device of each tool group. A rotatable cover disk is also traced by the control device of each tool group. The cover plate is rotatable and is coupled, for its rotation, to the rotation of the cylinder. The cam plate has a peripheral section that controls the tool working movement, in cooperation with the control device. The control section covers a maximum of 1/n of the periphery of the cam plate, where n is a whole number integer equal to, or larger than 2, in addition to a section that does not control the working movement of the tool group and which constitutes the rest of the cam plate periphery. The cover disk includes a first group of sections of different radii, which are traced by the control device, and which control device also traces the sections of the cam disk during the rotations of the cylinder body. At least one of those cover disk sections has a first radius which enables cooperation between the control device and the cover disk section. At least one other of the sections has a second radius which blocks such cooperation. At least one second group of sectors is also provided on the cover disk and is arranged between two sections of the first group of sectors. The radii of the first sectors and the second sectors are not the same.

31 Claims, 7 Drawing Sheets

U.S. PATENT DOCUMENTS

| | | | | | |
|---|---|---|---|---|---|
| 4,190,242 | A | * | 2/1980 | Bolza-Schunemann | 270/50 |
| 4,295,644 | A | * | 10/1981 | van der Meulen | 270/60 |
| 4,437,855 | A | * | 3/1984 | Bullen | 493/424 |
| 4,892,036 | A | | 1/1990 | Lange | |
| 5,000,433 | A | | 3/1991 | Prum et al. | |
| 5,039,076 | A | * | 8/1991 | Fischer | 270/47 |
| 5,065,993 | A | * | 11/1991 | Reponty | 270/49 |
| 5,078,374 | A | * | 1/1992 | Odeau | 270/49 |
| 5,305,993 | A | | 4/1994 | Staeb | |
| 6,250,622 | B1 | * | 6/2001 | Fowler et al. | 270/47 |
| 6,394,445 | B1 | * | 5/2002 | d'Agrella et al. | 271/182 |
| 6,550,385 | B1 | | 4/2003 | Colin et al. | |
| 2004/0152576 | A1 | | 8/2004 | Kostiza et al. | |

FOREIGN PATENT DOCUMENTS

| | | | |
|---|---|---|---|
| DE | 91 16 327.7 | | 8/1992 |
| DE | 43 16 352 | A1 | 11/1994 |
| DE | 44 08 202 | A1 | 9/1995 |
| DE | 101 21 559 | C1 | 10/2002 |
| EP | 0 098 415 | A2 | 1/1984 |
| EP | 0 098 415 | A3 | 1/1984 |
| EP | 1 415 943 | A1 | 5/2004 |
| GB | 2 287 243 | A | 9/1995 |
| GB | 2 291 409 | A | 1/1996 |

* cited by examiner

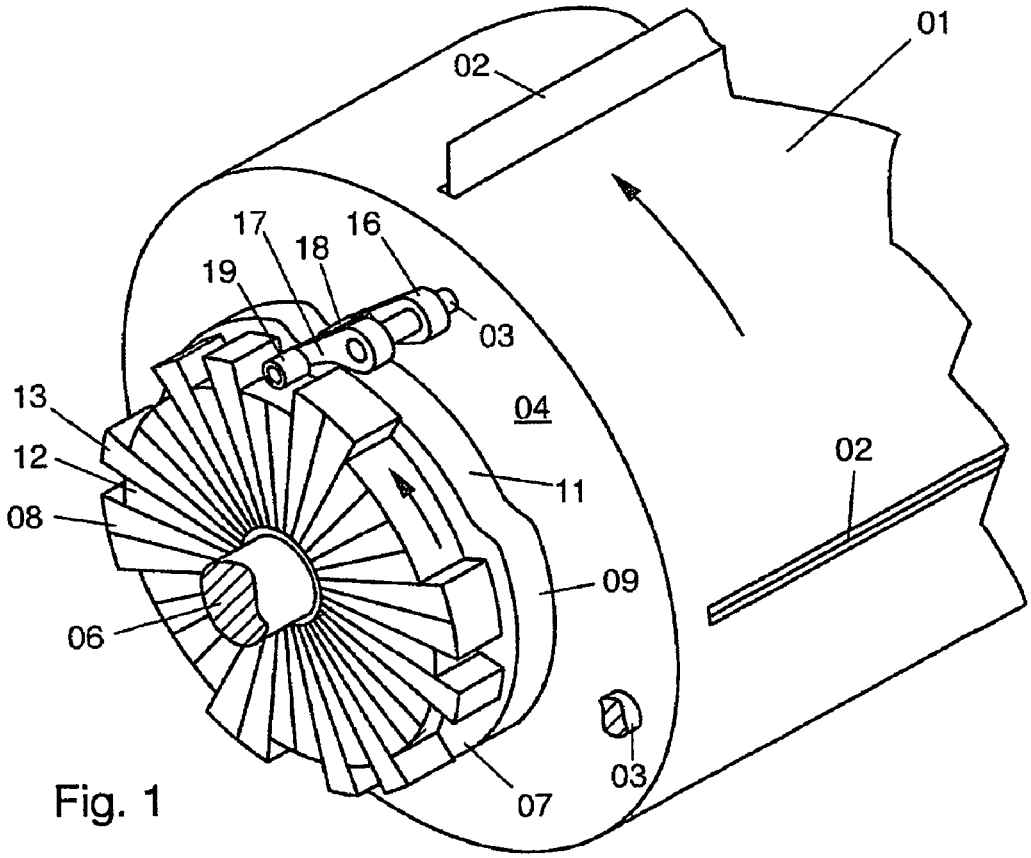
Fig. 1
Fig. 2
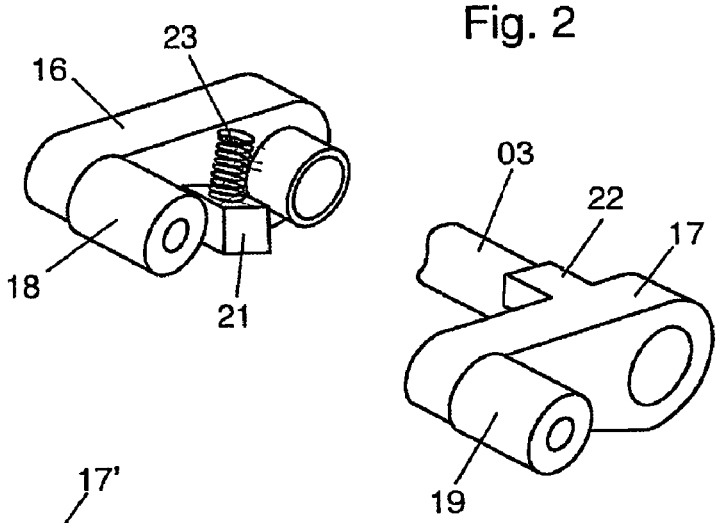
Fig. 3
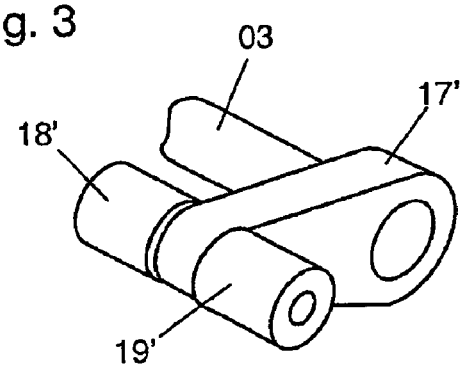

CYLINDER FOR PROCESSING FLAT MATERIAL

CROSS-REFERENCE TO RELATED APPLICATIONS

This application is the U.S. national phase, under 35 USC 371, of PCT/EP2005/051635, filed Apr. 13, 2005; published as WO 2005/102890 A2 and A3 on Nov. 3, 2005 and claiming priority to DE 10 2004 020 304.0, filed Apr. 26, 2004, the disclosures of which are expressly incorporated herein by reference.

FIELD OF THE INVENTION

The present invention is directed to cylinders for processing flat material and to a cylinder in a folding apparatus of a printing press The cylinder has a cylinder body which is rotatable about a cylinder axis and which has at least one group of tools which are evenly distributed around the circumference of the cylinder body. These tools are able to perform a work movement with respect to the cylinder body.

BACKGROUND OF THE INVENTION

It is known from DE 38 28 372 A1 to provide cams on a cover disk, which cams are displaceable in the radial direction. It is possible, by the use of these cams, to form sections on the cover disk which, when being scanned, or traced by the control lever, block a work movement of a tool. It is possible to match the cover disk to the respective production process by a suitable distribution of the sections on the cover disk. Moreover, cover disks are generally known and which are comprised of several partial cover disks. The several partial cover disks are displaced, relative to each other, by motors in order to make a change between modes of production. However, in both of the above-described cases, the construction of the cover disk and of the cylinder is very complex and includes many individual parts. The result is that a switch between modes of production is very complicated and time consuming.

U.S. Pat. No. 4,094,499 discloses a cylinder for processing flat material, and having a cylinder body which is rotatable around a cylinder axis, and on which cylinder body controllable tools are arranged. These tools are controlled by a cam disk and by a cover disk. These disks have sectors of different radii.

U.S. Pat. No. 5,305,993 discloses a cylinder for processing flat material, and having a cylinder body which is rotatable around a cylinder axis. At least one group of several tools is uniformly arranged over the circumference of the cylinder body, which tools are arranged for performing a work movement with respect to the cylinder body. The tools are couples to a control arrangement for driving the work movement, to a stationary cam disk, which is scanned by a control arrangement of each tool, and to a rotatable cover disk that is coupled to the rotation of the cylinder body, and which is scanned by the control arrangement of each tool. The cylinder has an operating mode triple collating operation.

SUMMARY OF THE INVENTION

The object of the present invention is directed to providing cylinders for processing flat material with a simple production change.

In accordance with the present invention, the object is attained by the provision of a cylinder having a cylinder body which is rotatable around a cylinder axis and which has at least one group of several tools that are evenly distributed around the circumference of the cylinder body. These tools are arranged to perform a work movement with respect to the cylinder body and are coupled to a control arrangement for driving the work movement. A stationary cam disk is traced by the control arrangement of each tool. A rotatable cover disk is coupled to the rotation of the cylinder body and is also traced by the control arrangement. The cam disk includes at least one circumferential section which controls the work movement and a section which does not control the work movement of the tools.

The advantages which can be obtained by the present invention lie, in particular, in that the same cover disk can be used without retrofitting steps, or without other structural modifications, for different modes of production of the cylinder. For example, those different production modes could be ones in which the cylinder collimates either one work piece or several work pieces, but at most collimates n−1 work pieces, out of the flat material, which work pieces are preferably signatures made of paper. A sector group of the cover disk is assigned to each mode of production. A sequence of these sectors, which may be, for example, circular sectors, and having a first or a second radius, is specific for the associated production mode within the group. Each sequence of sectors permits or blocks the work movement of the tools in accordance with the associated production mode. If the cylinder is operated in a specific production mode, the control arrangement, together with the section controlling the work movement, only passes sectors of the cover disk of a single selected sector group. If, for example, in one of the sector groups all of the sectors have the same radius, the same work movement of the tools takes place during each revolution of the cylinder in the course of the operation of the cylinder in the production mode of the cylinder which is determined by this sector group.

Since the cover disk is rotatably coupled to the rotation of the cylinder body, it is easy to switch between two production modes by appropriately setting a phase between the cover disk and the cylinder body. Sectors of the group of sectors which is a part of the desired production mode either permit, or block, cooperation of the control arrangement and the section for controlling the work movement.

Wear of the control arrangement of the cylinder is reduced, because a relative speed between the rotating cylinder body and the cover disk is reduced. The cover disk comprises several sector groups, so that a number of the sectors of the cover disk is increased, in comparison with generally known, constructions. The difference of the rotatory speeds of the cylinder body and of the cover disk, which is required for controlling the tool movement at the desired periodicity, is clearly reduced. The acceleration which is experienced by a roller of the control arrangement, which roller traces the cover disk every time it comes into contact with the cover disk, is reduced by this. Since the frictional wear of the roller of the cover disk is disproportionally increased as acceleration increases, the service life of the roller is considerably increased by this reduction in speed differential.

The roller which is used for scanning or tracing the cover disk can be simply mounted on a common control lever together with a roller which is intended for scanning or tracing the cam disk. In such an arrangement, the roller of the cam curve will always lose contact with the cam disk when the cover disk blocks the work movement of the control arrangement. When the roller loses contact, it is slowed down and must be accelerated again. To prevent this loss of contact, it is also possible to provide two control levers, one for each roller, which provision of two control levers permits the roller of the cam disk to remain in contact with the cam disk even if the cover disk blocks the work movement.

The cover disk can be coupled with the cylinder body through a compensation drive, such as, for example, a planetary gear or a harmonic drive gear. When a compensating shaft of this compensation drive is locked, this gear can be used as the drive mechanism for the cover disk. A rotation of the compensating shaft of this same gear can make possible a switching of the production modes of the cylinder.

BRIEF DESCRIPTION OF THE DRAWINGS

A preferred embodiment of the present invention is represented in the drawings and will be described in greater detail in what follows.

Shown are in:

FIG. 1, a partial perspective view of a cylinder with folding blades in accordance with the present invention, in FIG. 2, an exploded detailed perspective view of the control arrangement with two control levers of a folding blade of the cylinder depicted in FIG. 1, in FIG. 3, a detailed perspective view of a simplified control arrangement with one control lever and with two rollers mounted thereon, in FIG. 4, an end view of a first embodiment of a cover disk for a cylinder with folding blades, in FIG. 5, an end view of a further embodiment of a cover disk for a cylinder with folding blades, in FIG. 6*a*)-6*f*), the depiction of modes of functioning of the cover disk for three production modes of the cylinder, in FIG. 7, an end cover disk for use with a cylinder having grippers, in FIG. 8, a schematic depiction of a gear drive arrangement of a collating cylinder, and in FIG. 9, a schematic depiction of a second gear drive arrangement of a collating cylinder.

DESCRIPTION OF THE PREFERRED EMBODIMENTS

Figure 4:
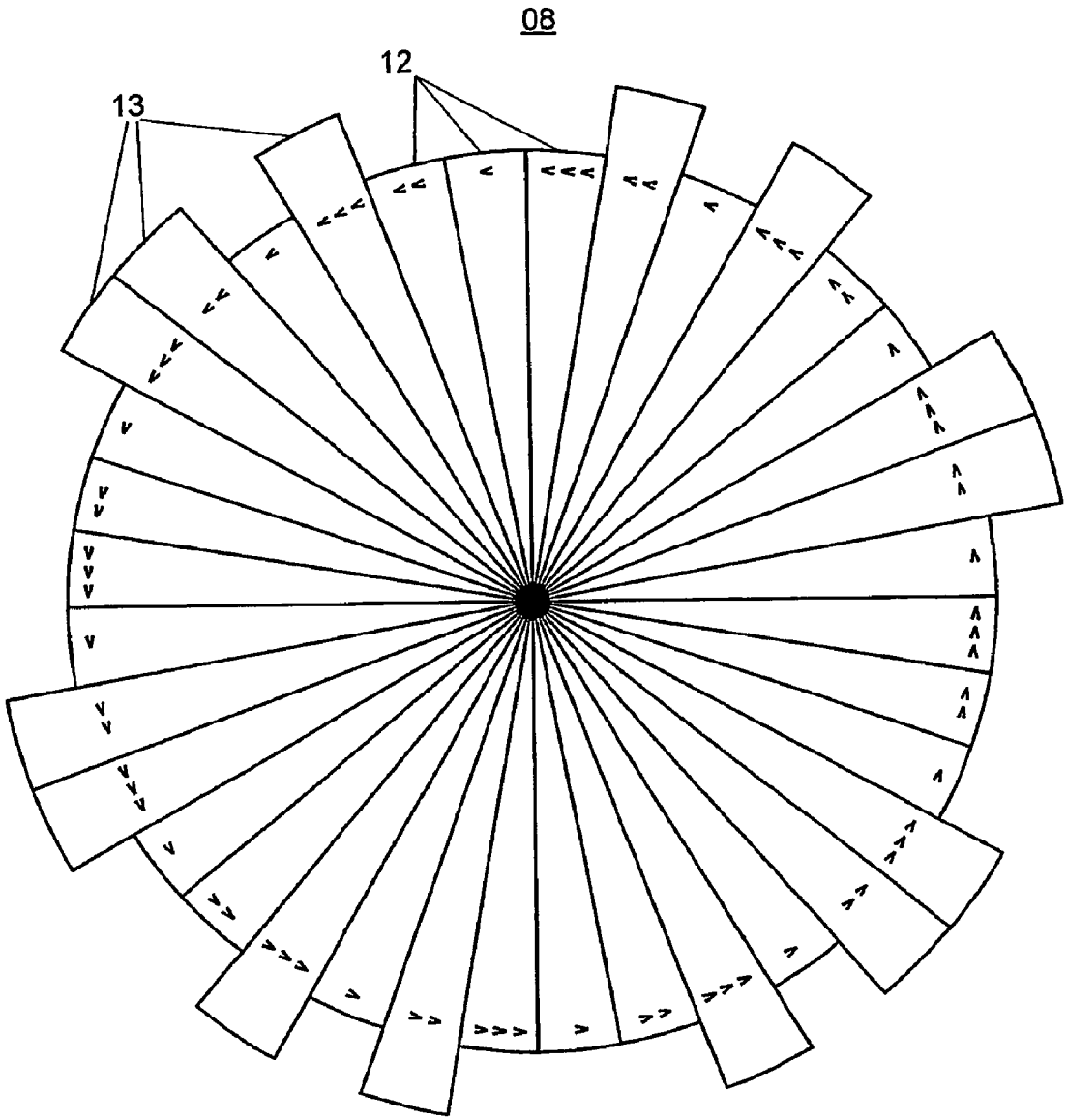

Referring initially to FIG. 1, there is shown a perspective view of an end section of a cylinder body 01 with three folding blades, two of which folding blades are visible in FIG. 1. For the sake of simplicity, the cylinder body 01 has been represented in FIG. 1 in the narrow, geometric sense. However, it is to be understood that it is possible, in actuality, to depart from the depicted geometric cylinder shape, provided that signatures on the shell face of the cylinder 01 are conveyed on a path which is shaped as a circle or as a sector of a circle. It is possible, in particular, for the shell surface of the cylinder 01 to be constructed of a plurality of segments, which segments can be shifted with respect to each other. The tools 02, such as, for example, the folding blades, can be extended out of slits which are arranged at a spacing of 120° with respect to each other on the shell surface of the cylinder body 01. Such an extension is done in order to transversely fold conveyed signatures at a transfer gap, which is not specifically represented and, in the process, to transfer the now transversely folded signatures to an also not represented folding jaw cylinder. To be able to load a subsequent or following signature onto the cylinder body 01, the folding blades 02 must previously be retracted into the interior of the cylinder 01. To accomplish this task, the folding blades 02 are each fixedly connected with a respective shaft 03, as seen in FIG. 1, by the use of arms, which arms are hidden by the shell of the cylinder body 01 in FIG. 1. Each of these arms is pivotably seated in two oppositely located front or end plates 04 of the cylinder body 01. Journals 06 of the cylinder 01, which journals 06 are connected with the front or end plates 04, are rotatably seated in a lateral frame, which is not specifically represented. A cam disk 07 and a cover disk 08 are provided coaxially with respect to the journal 06, as represented in FIG. 1. The cam disk 07 has substantially the shape of a circular disk and is arranged concentrically with respect to the axis of rotation of the cylinder body 01. A section 09 of the cam disk 07 such as, for example, the circumferential face 09 of the cam disk 07 has been formed with a circumferential section 11, such as, for example, an indentation 11. The cover disk 08 can be understood, and can be seen in FIG. 1, as having been constructed of sectors 12, 13, such as, for example, a plurality of circular sectors 12. 13.

Each one of the three shafts 03 of the cylinder body 01 supports two control levers 16, 17, each of which control levers 16, 17 forms a control arrangement for controlling the movement of a respective one of the folding blades 02. For the sake of clarity, the control levers 16, 17 are represented in FIG. 1 on only one of the three shafts 03. The first control lever 16 has a roller 18 on its free end, which roller 18 rolls off on the circumferential surface of the cam disk 07. In an analogous manner, the second control lever 17 has a roller 19 on its free end, which roller 19 rolls off on the circumferential surface of the cover disk 08. The second control lever 17 is fixedly connected with the shaft 03, while the first control lever 16 can be rotated around the shaft 03.

The two control levers 16, 17 have protrusions 21 or 22, respectively on their lateral flanks, with each such protrusion 21, 22 facing the other control lever 16, 17, as can be seen in the expanded detailed representation of the control arrangement, which is shown in FIG. 2. A pressure spring 23, which drives the two protrusions 21, 22 apart from each other, lies between the two protrusions 21, 22, as may also be seen in FIG. 2. The torque of a spring, which is not specifically represented, and which may be housed, for example, in the cylinder body 01, acts through the shaft 03 on the second control lever 17 and drives the roller 19 of the second control lever 17 against the circumferential surface of the cover disk 08. In the position which is represented in FIG. 1, the first roller 18 rolls off in the indentation 11 on the circumferential face 09 of the cam disk 07, and the roller 19 rolls off on a first sector 12 of the cover disk 08. When the first roller 18 rolls off on the circumferential face 09 while the second roller 19 lies opposite a first sector 12, the second roller 19 does not touch the cover disk 08, since a contact between the protrusions 21, 22 of the two control levers 16, 17, and the support of the first roller 18 of the first control lever 16, which simultaneously rolls off on the circumferential face 09, prevent this contact of roller 19 with cover disk 08. In the course of a complete revolution of the cylinder body 01, the roller 18 is in contact with the cam disk 07 and because of this contact, this roller 18 is being uniformly rotatorily driven. When the first roller 18 enters the indentation 11, this leads to a movement of the folding blades 02 only if, at the same time that the first roller 18 enters the indentation 11, the second roller 19 is located opposite a section 13 of the cover disk 08 with a small radius, as represented in FIG. 1. If this is not the case, the second roller 19 loses contact with the cover disk 08 and is slowed until it again comes into contact with a section 12 of a large radius.

In a perspective plan view, which is analogous to FIG. 2, FIG. 3 shows a simplified control arrangement, in which a single control lever 17', which is fastened on the shaft 03, supports two rollers 18', 19' for rolling off on the cam disk 07 or on the cover disk 08, respectively. The control lever 17' pivots radially inward only in the case where both rollers 18', 19' simultaneously pass the indentation 11 of the cam disk 07 or a section 12 of the cover disk 08 of a small radius.

In place of the three folding blades 02, or spur needle strips with spur needles, or grippers or folding jaws, the cylinder 01 can also have five or seven sections, and can thus have five or seven groups of tools 02, in particular five or seven groups of folding blades 02, or spur needle strips with spur needles, or grippers or folding jaws.

FIG. 4 shows a front plan view of the cover disk 08. Although cover disk 08 is, in actuality, made of one piece, with respect to its functions, it can be divided, as will be discussed subsequently in connection with FIG. 6, into first circular sectors 12 of a small radius and second circular sectors 13 of a large radius, which large radius sector 13 have been drawn in heavier lines in the various drawings for the purpose of making matters more clear. Each sector group of the cover disk 08 is comprised of twelve individual sectors 12, 13.

Each individual sector 12, 13 is a part of one of three sector groups. The group affiliation for each sector 12, 13 is shown by a symbol "<", "<<" or "<<<", with which each such sector 12, 13 has been provided, as is shown in FIG. 4. The sectors 12, 13 of the individual sector groups "<", "<<", "<<<" cyclically alternate in the circumferential direction of the cover disk 08. Between each of two sectors 12, 13 of the same sector group "<", "<<", "<<<" a sector 12, 13 of each of the respectively other sector group "<", "<<", "<<<" is arranged.

All twelve sectors of the first group of sectors "<" are sectors 12 of small radius. This first group "<" is used for control during non-collating operations. When, in the course of each passage over the indentation 11, the control arrangement 16, 17 or 17' meets a sector 12 of this group "<", the control arrangement follows the contour of the indentation 11 on the cam disk 07 and the folding blades perform the appropriate work movement. They are extended during each passage of the transfer gap, which is not specifically represented, and are subsequently retracted into the cylinder body 01.

The cam disk 07 includes a circumferential section 11 which controls the work movement in cooperation with the control arrangement 16, 17, 17', and which, when "n" is a whole number equal to or greater than 2, amounts to at most 1/n of the total circumference of the cam disk 07. Cam disk 07 also includes a section which is not controlling the work movement of the tool groups and which second section amounts to the remainder of the total circumference of the cam disk 07.

Figure 6:
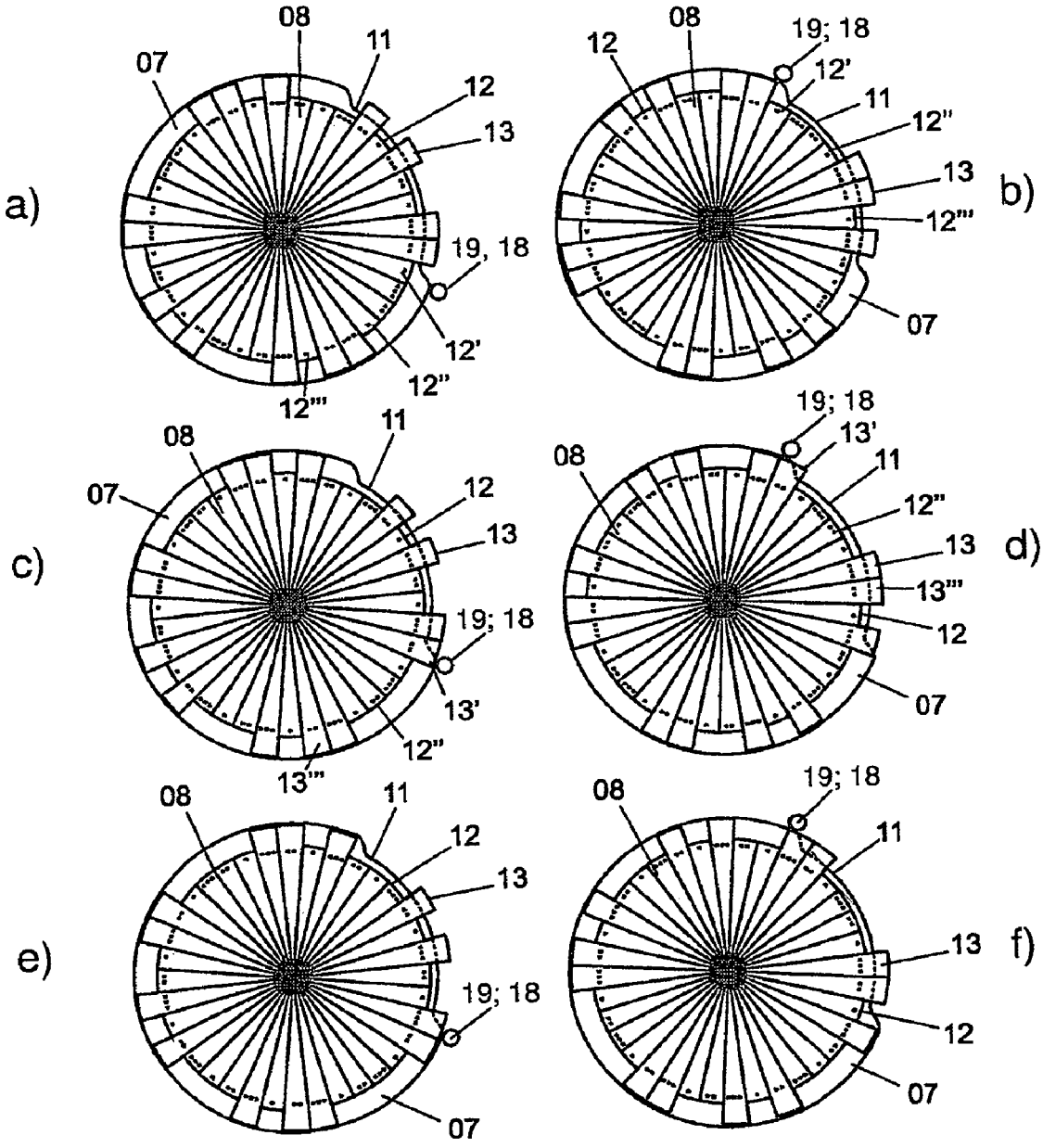

FIGS. 6 *a*) and *b*) are intended to illustrate the mode of functioning of the cover disk 08 during a non-collating production mode of the cylinder 01. The rollers 18, 19 circle the cam and cover disks 07, 08, respectively, in a counterclockwise direction. While the cam disk 07 is stationary, the cover disk 08 is coupled with the cylinder body 01 and rotates in the same direction as it does but, in a manner corresponding to the number 12 of sectors of each group, slower by 1/12. In the situation which is represented in FIG. 6*a*), the cam disk roller 18 is almost ready to pass the indentation 11. The phase relationship between the cover disk 08 and the cam disk 07 have been selected such that the cover disk roller 19 has, at this time, entered the angular range of a first sector 12' of the sector group "<". The cam disk roller 18 enters the indentation 11 in the cam disk 07 in the continued course of the rotation of the cylinder 01, and the associated folding blade 02 is extended. During the time in which the cam disk roller 18 crosses the indentation 11 in the cam disk 07, the roller 19 rolls off exclusively on the first sector 12' of the cover disk 08. After the cam disk roller 18 has reached the end of the indentation 11, the folding blade 02 is again retracted. Immediately following the crossing of the cam disk roller 18 through the indentation 11, the cover disk roller 19 has left the first sector 12' behind, which can be seen in FIG. 6*b*). In the course of the continued rotation of the cylinder body 01, during which the cam disk roller 18 rolls off on the circumferential face 09 of the cam disk 07, the folding blade 02 remains retracted. When, after a complete rotation of the cylinder 01, the cam disk roller 18 again reaches the start of the indentation 11, the cover disk 08 has now turned or rotated sufficiently far so that the cover disk roller 19 is in the angular range of the next sector 12" of the same sector group "<". In the course of the subsequent crossing of the indentation 11 by the cam disk roller 18, the cover disk roller 19 therefore rolls off on the first sector 12", and the folding blade 02 is extended when the cam disk roller 18 dips into the indentation 11 and is retracted again when the cam disk roller 18 again comes out of the indentation 11. One revolution later, it is the sector 12'"of the cover disk 08 which follows the first sector 12" within the group "<", on which the roller 19 rolls off when the cam disk roller 18 crosses the indentation 11. During each following revolution, it is always one of the sectors marked by "<" in whose angular range the roller 19 is located when the roller 18 crosses the indentation 11. Since the sectors marked by "<" are exclusively the first sector 12 of the cover disk of small radius, the folding blade 02 is extended during each revolution of the cylinder body 01. The cylinder 01 now operates in the non-collating production mode.

In comparison to this non-collating production mode shown in FIGS. 6*a*) and *b*), FIGS. 6 *c*) and *d*) represent the mode of functioning of the cylinder 01 in the single collating production mode. To reach the single collating production mode from the non-collating production mode, the phase of the rotation of the cover disk 08, with respect to the cam disk, has been set in such a way that the situation shown in FIG. 6 *c*) results, in which the cam disk roller 18 is located at the start of the indentation 11. Now the cover disk roller 19 is at the height of a second sector 13' of a large radius, which second sector belongs to the second sector group "<<" of the single collating production mode. The cover disk roller 19 rolls off on this second sector 13' until the situation depicted in FIG. 6 *d*) results. During the time in which the cover disk roller 19 rolls off on the second sector 13', the cam disk roller 18 passes the indentation 11. However, because of the large radius of the second sector 13', the cam disk roller 18 cannot enter the indentation 11. The cam disk roller 18 does not touch the cam disk 07 during the time the cover disk roller 19 rolls off on the second sector 13'. Therefore, the control lever for the folding blade 02 is not actuated and the latter is not extended. One revolution of the cylinder body 01 later, the cover disk roller 19 rolls off, as described above, on the sector 12" which follows the second sector 13' within the sector group "<<". However, since this is a first sector 12" of a small radius, this time the folding blade 02 is extended, as described above, when the cam disk roller 18 crosses through the indentation 11 of the cam disk 07. Because the sector 13'", which follows the first sector 12" in the second sector group "<<" has a large radius, the folding blade 02 is again not extended one revolution later. By the alternating arrangement of first sectors 12 and second sectors 13 in the second sector group "<<" belonging to the single collating production mode, it can be seen that during each revolution of the cylinder body 01 the folding blade is alternatingly extended one time and is not extended the next time.

From the above explanations, the mode of functioning of the cover disk 08 during the dual collating production mode, as represented in FIGS. 6 *e*)and *f*), can be easily seen. The situation shortly prior to the cam disk roller 18 passing through the indentation 11, analogously to the above descriptions, is represented in FIG. 6 *e*), and the situation directly after the passage of the cam disk roller 18 is depicted in FIG. 6 *f*). Between these two times, the cover disk roller 19 rolls off on a second sector 13 so that, the folding blade is not extended. Within the third sector group "<<<", which corresponds to the dual collating production mode, respectively two second large radius sectors 13 follow each first small radius sector 12. Therefore, after the extension of the folding blade 02, two revolutions of the cylinder body follow, in which the folding blade 02 is not extended. The cylinder 01 now operates in the dual collating production mode.

Figure 5:
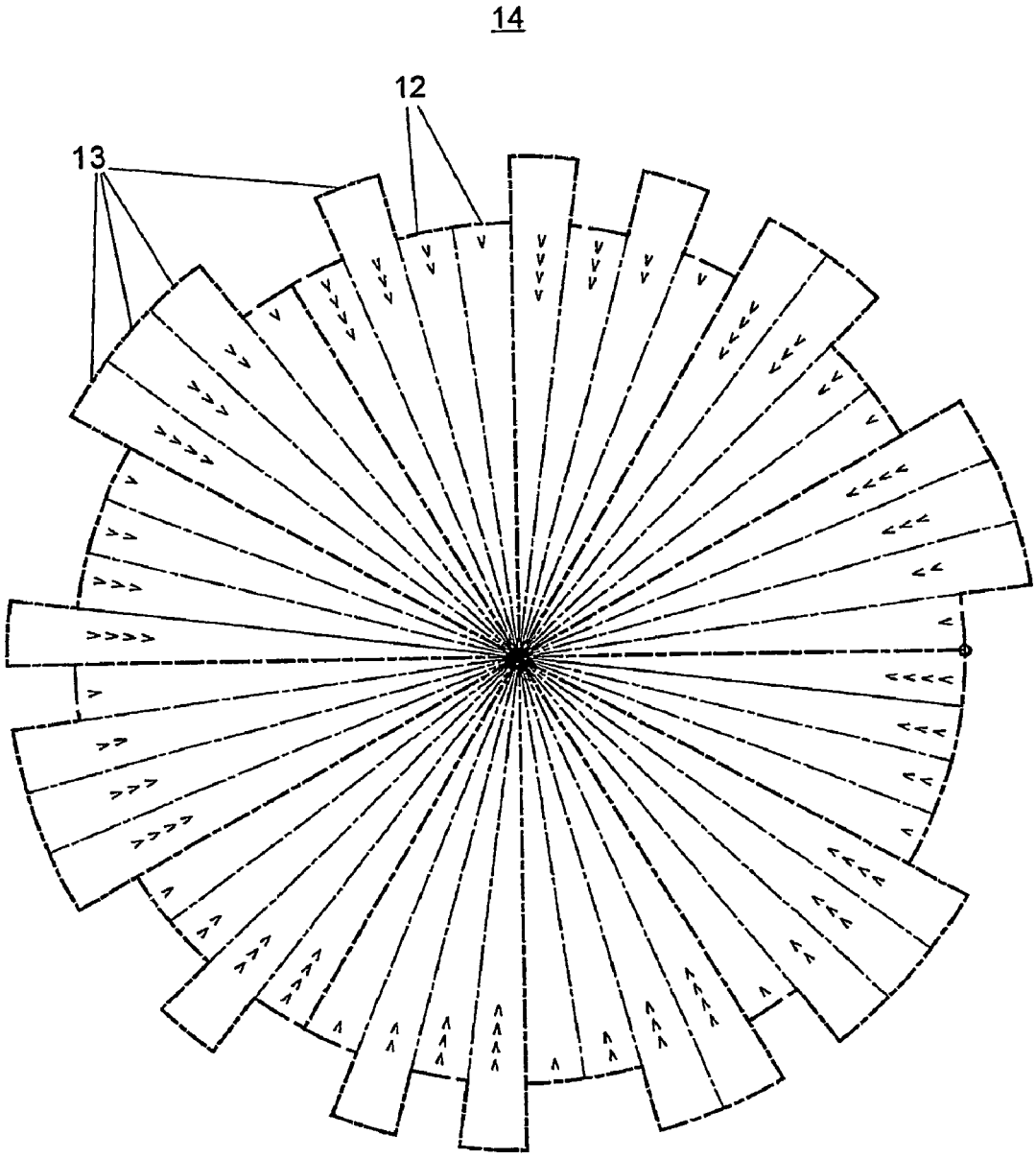

The cover disk 08 could, of course, also have still further sector groups beyond the first, second and third sector groups "<", "<<", "<<<", such as, for example, a fourth sector group "<<<<", which has one small radius sector 12 for respectively three large radius sectors 13 in order to provide a triple collating production mode. FIG. 5 shows such a four sector group cover disk 14 with four different sector groups "<", "<<", "<<<" and "<<<<". With the cover disk 14 the number of sectors of every sector group is 12.

In the above-described preferred embodiments, only folding blades 02 were discussed and depicted as examples of tools which are attached to the cylinder body 01 and which are periodically driven. It is, of course, understood that the present invention can also be used in the same manner, as has been described above, in connection with other periodically moved tools, such as folding blades, spur needle strips with spur needles, grippers, folding jaws and the like.

Figure 7:
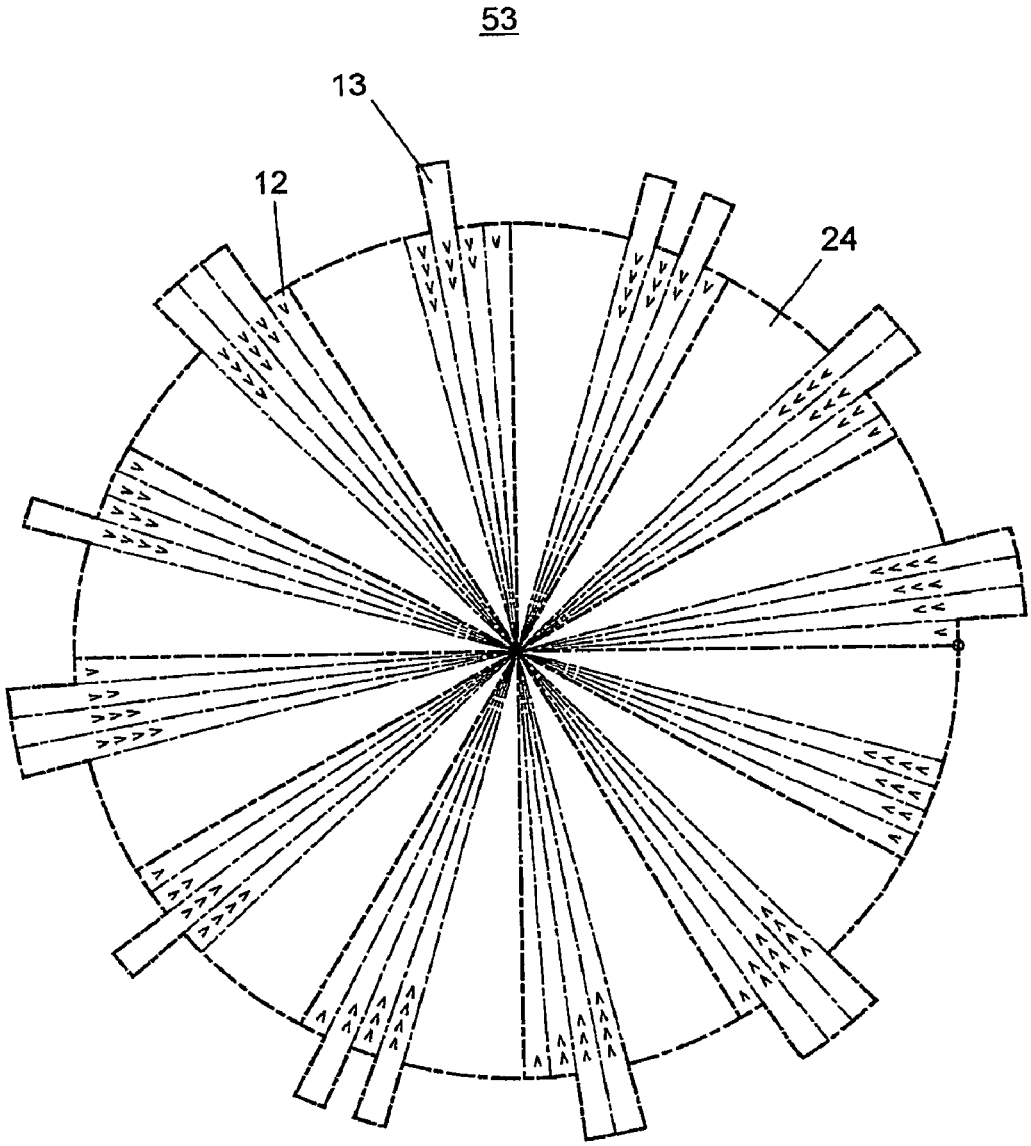

As an example of a cover disk 53 which is suitable for controlling the work movements of tools that are different from folding blades 02, FIG. 7 shows a cover disk 53 which is suitable for controlling grippers of a gripper cylinder. The cover disk has four different sector groups, each with sectors 12, 13. As explained above, sectors 12, 13 belonging to the same sector group are marked by "<", "<<", "<<<" or "<<<<". The symbols simultaneously stand for the production modes which can be realized by the use of the respective sector group "<", "<<", "<<<" or "<<<<". The sheet end grippers move once during every revolution of the cylinder 01 to pick up a freshly fed-in signature, and, depending on the selected production mode, they move a second time during each one or several revolutions of the cylinder in order to release the signatures. In the course of a release movement, the cover disk roller 19 moves over one of the respective sectors 12 or 13 of the group corresponding to the respectively selected production mode. The pick-up movement is controlled in that the cover disk roller 19 rolls off on one of the small radius areas 24 which are located between four respective sectors 12, 13, which small radius areas 24 are not counted among the four sector groups and which have a small radius like the sectors 12. Therefore a cam disk, which is working together with the cover disk 53, customarily has, in addition to the indentation 11, by the use of which the release of the signatures is controlled as a function of the production type, a further indentation which, together with the small radius areas 24, controls the pick-up of the signatures.

Figure 8:
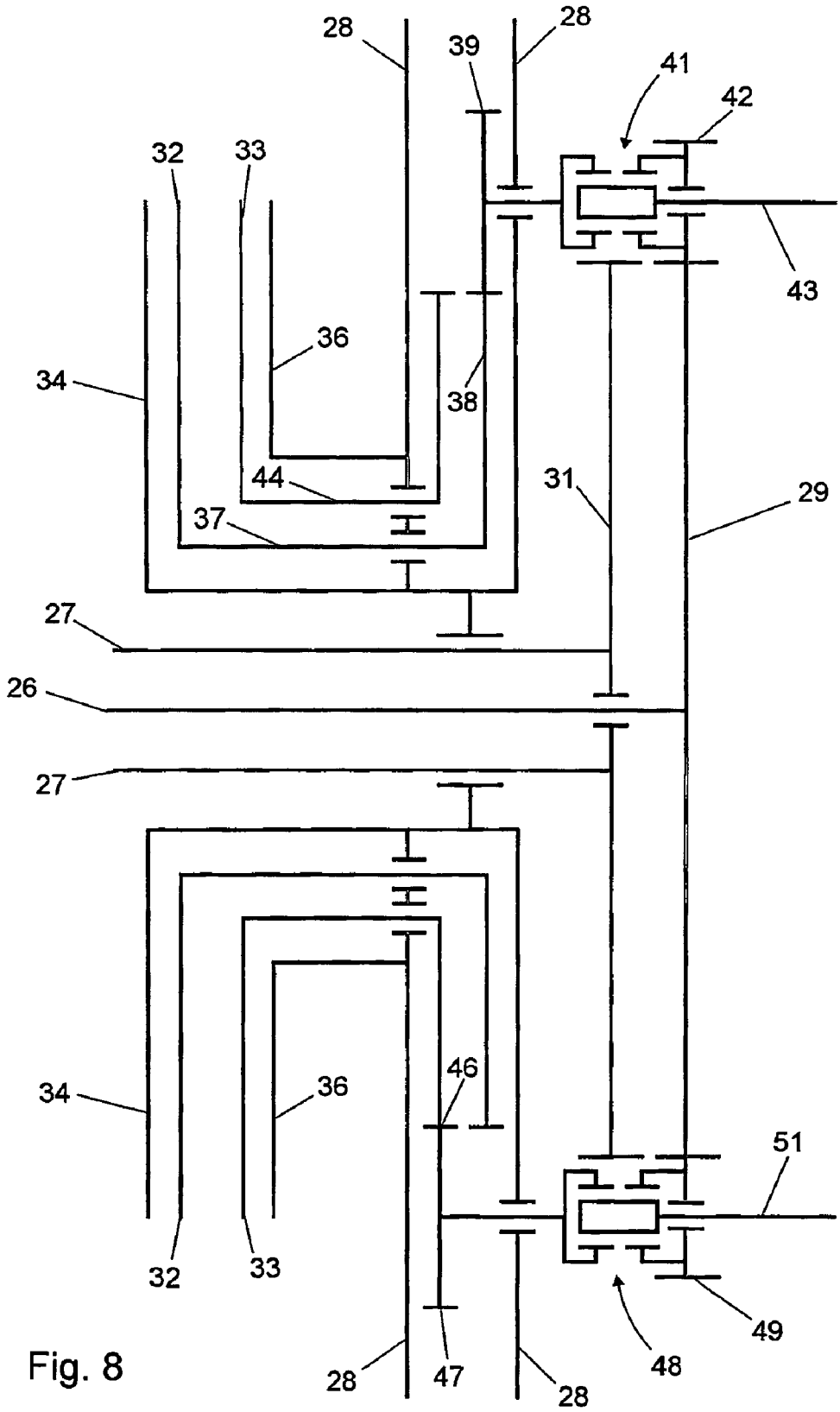

A gear arrangement for accomplishing the rotation of a cylinder 01 of a folding apparatus, such as is, as a rule, arranged downstream of a web-fed rotary printing press, can be seen in FIG. 8. For tools 02, the cylinder 01 has several folding blades 02 which are distributed evenly over the circumference of its cylinder body 01. Cylinder 01 also has groups of several grippers which are also distributed evenly over the circumference of the cylinder body 01. As described in the previously mentioned DE 38 28 372 A1, the cylinder 01 consists of two segments, which are each star-shaped in cross section, which can be uniformly driven and which can be shifted in respect to each other. One segment is in the form of a laterally seated folding blade element with the folding blades. The other segment is a gripper element with the grippers. The folding blade element has a journal 26 and the gripper element a journal 27. The gripper element journal 27 is embodied to be hollow and the folding blade journal 26 extends through it, so that both journals 26, 27 are coaxially seated in a frame 28. A drive gear wheel 29, for use in driving the folding blade element, is fastened on the journal 26, and a drive gear wheel 31 for driving the gripper element is fastened on the journal 27. The drive wheels 29, 31 are arranged coaxially next to each other and have the same diameter.

A cover disk 32, which is intended for use in controlling the folding blades, is fastened on a hollow cylinder 37, which is seated coaxially with the journals 26, 27 and which rotatable around them in the frame 28 and is therefore also arranged coaxially with the journals 26, 27 and is rotatable around them. A cam disk 34, which is situated adjacent to the cover disk 32, is fixedly connected with the frame 28. The folding blades are controlled, as described above, by the operation of the cover disk 32 and the cam disk 34, as well as by the use of non-represented control levers. The folding blade cover disk hollow cylinder 37 has a folding blade crown gear 38 at an end of cylinder 37 which is opposite the cover disk 32. The folding blade cover disk crown gear 38 is in engagement with a gear wheel 39 of a folding blade compensating gear 41, such as, for example, a planetary gear or a harmonic drive gear 41, which folding blade compensating gear 41 is in engagement with the drive wheel 29 of the folding blade element via a further gear wheel 42. Any arbitrary phase relationship between the folding blade crown gear 38, and therefore between the folding blade cover disk 32 and folding blade element, can be set by the use of a folding blade compensating shaft 43 of the harmonic drive gear 41.

A gripper cover disk 33, for use in controlling the grippers, is fastened in the same way as the folding blade cover disk 32 at an end of the gripper cover disk hollow cylinder 44 which surrounds the folding blade cover disk hollow cylinder 37 and is rotatably seated around the latter. Therefore, the gripper cover disk 33 is also seated coaxially with the journals 26, 27 and can be rotated around them. A gripper cam disk 36, adjoining the gripper cover disk 33, is also fixedly connected with the frame 28 and, in the same manner, as was described above, and together with the cover disk 33, is used for controlling the grippers. A representation of the associated control levers has been omitted. The hollow gripper cover disk cylinder 44 also has a gripper crown gear 46 at its end opposite the cover disk 33. The gripper crown gear 46 is in engagement with a gear wheel 47 of a gripper compensating gear 48, such as, for example, a planetary gear or a harmonic drive gear 48, which is in engagement with the folding blade drive wheel 28 via a gear wheel 49. Any arbitrary phase relationship between the cover disk 33 and the gripper element can be set via a compensating shaft 51 of the harmonic drive gear 48.

The gear arrangement, which is represented in FIG. 8, sees to a coupling of the cover disks 32, 33 to a rotation of the folding blade element and the gripper element. These cover disks 32, 33 are driven via the respective drive wheels 29, 31. Since the two separate harmonic drive gears 41, 48 are both in engagement with the drive wheel 29 of the folding blade element, as well as with their respective, appropriate crown gears 38, 46, the drive wheel 29 also drives the cover disks 32, 33. Provided the harmonic drive gears 41, 48 provide a gear ratio of $$1:\frac{1-s}{s} \quad \text{or} \quad 1:\frac{1+s}{s}$$

wherein s is the number of sectors for each sector group "<", "<<", "<<<", "<<<<", the cover disks 32, 33 rotate in such a way that, as described above, only sectors 12, 13 of the same sector group "<", "<<", "<<<", "<<<<", together with the rollers 18, 19, 18', 19' of the control levers 16, 17, 17' pass the indentations of the cam disks 34, 36.

It is possible to switch between the several individual production types discussed above by operation of the compensating shafts 43, 51. By shifting the cover disks 32, 33, with respect to the folding blade element and to the gripper element, by use of the compensating shafts 43, 51 and the harmonic drive gears 41, 48, it is possible to adjust a phase between the cover disks 32, 33 and the respective folding blade element or the gripper element. The result is that only sectors of such a sector group "<", "<<", "<<<", "<<<<", together with rollers 18, 19, 18', 19' of the control levers 16, 17, 17', pass the indentations of the cam disks 34, 36 which are part of the desired production type.

Figure 9:
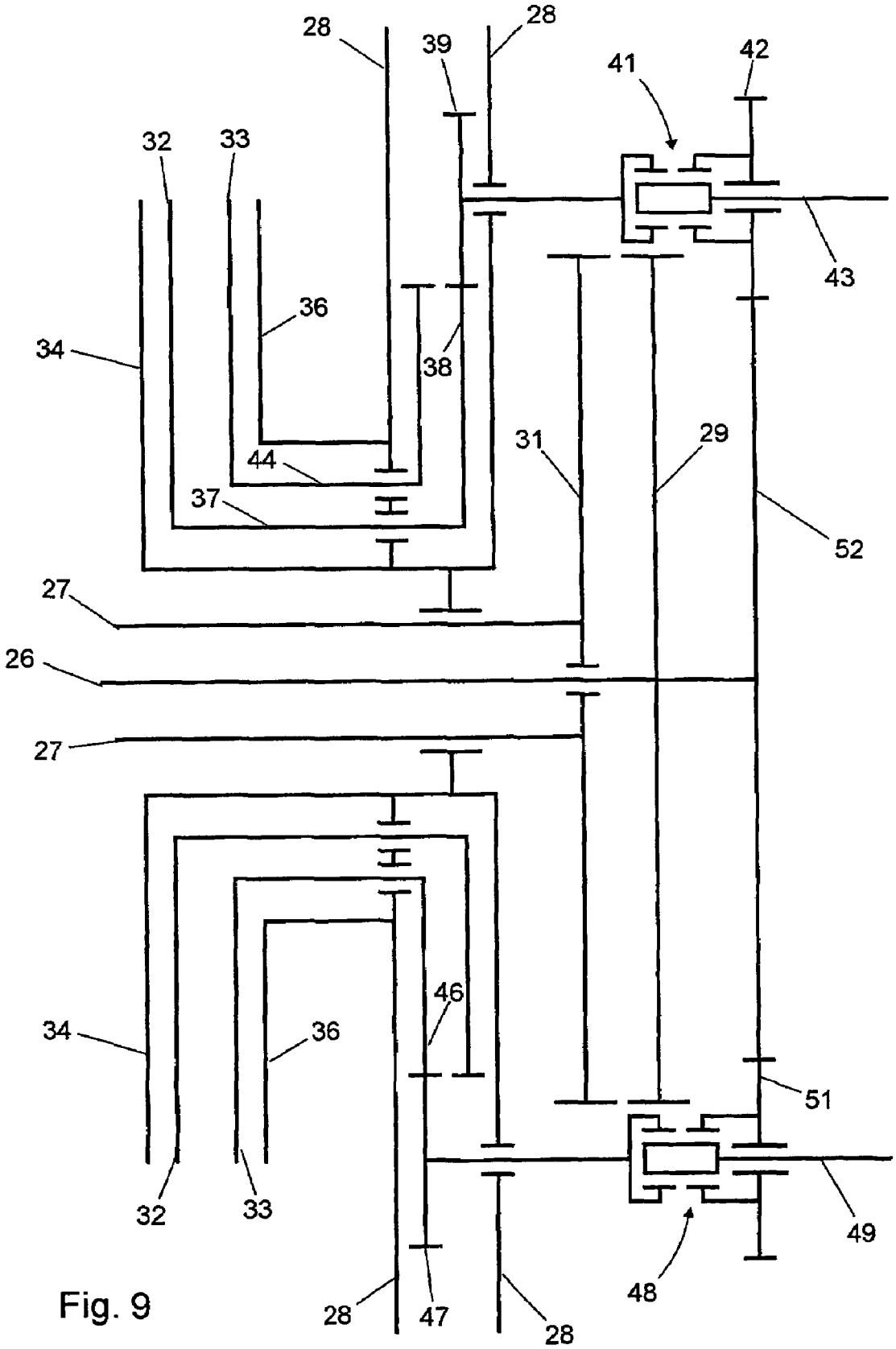

FIG. 9 shows an alternative embodiment of the gear arrangement shown and discussed in connection with FIG. 8. In contrast to the gear arrangement which is represented in FIG. 8, in this alternative embodiment an additional drive gear wheel 52 has been fastened to the folding blade element journal 26. The harmonic drive gears 41, 48 are in engagement with this additional drive gear wheel 52, so that the cover disks 32, 33 are operated indirectly, so to speak, via the drive wheel 52 instead of, as depicted in FIG. 8, directly via the drive wheel 29 through which a force flow into the gear takes place.

The cylinder body 01, as well as the cover disk 08, may rotate, for example, in a counterclockwise direction. The control arrangement 16, 17, 17' is embodied to precess, for example.

Driving of the cover disk 08, 14, 53 takes place from the folding blade cylinder, the folding gripper cylinder, the spur needle cylinder or the folding jaw cylinder.

The cylinder 01 is in a folding apparatus of a printing press and supports movable tools, which movable tools can be controlled by the use of a cover disk 08, 14, 53. The cover disk 08, 14, 53 can be driven by its own positionally-regulated electric motor.

The first sector group "<" determines the operating mode "non-collating operation".

The second sector group "<<" determines the operating mode "single collating operation".

The third sector group "<<<" determines the operating mode "dual collating operation".

The fourth sector group "<<<<" determines the operating mode "triple collating operation".

The fifth sector group "<<<<<" determines the operating mode "quadruple collating operation" which quadruple collating mode of operation is not specifically represented.

The cylinder 01 has five tools 02.

While preferred embodiments of a cylinder for processing flat material, in accordance with the present invention, have been set forth fully and completely hereinabove, it will be apparent to one of skill in the art that various changes in, for example the overall structure of the printing press in which the cylinder can be used, the specific structure of the groups of tools and the like could be made without departing from the true spirit and scope of the present invention which is accordingly to be limited only by the appended claims.

What is claimed is:

1. A cylinder for processing flat material comprising:

a cylinder body rotatable at a first speed about a cylinder body axis of rotation and having a cylinder body circumference;

at least a first group of tools evenly distributed around said cylinder body circumference, with each tool in said at least first group of tools being adapted to selectively perform a work movement with respect to said cylinder body;

a control arrangement coupled to each of said tools in said at least first group of tools and usable for selectively driving said work movement of each said tool;

a stationary cam disk having a first circumferential work movement control section traced by said control arrangement for each tool of said at least first group of tools and controlling said work movement of each said tool, said stationary cam disk also having a second circumferential section traced by said control arrangement and not controlling said work movement, said work movement control section having a portion of said stationary cam disk circumference not greater than 1/n wherein n is a whole number equal to or greater than 2;

a rotatable cover disk which is variably coupled to a rotation of said cylinder body, said rotatable cover disk also being traced by said control arrangement for each said tool in said at least first group of tools, said rotatable cover disk being driven for rotation at a second, variable speed different from said first speed; and at least three sector groups on said rotatable cover disk, a first one of said sector groups having sectors of a first radius, second and third ones of said at least three sector groups each having sectors of at least first and second different radii, said first radius of all of said at least three sector group permitting cooperation between said control arrangement and said first circumferential section of said cam disk for allowing said work movement of each said tool of said at least first group of tools, said second radius of each of second and third ones of said at least three said sector groups blocking said cooperation and blocking said work movement, said at least three sector groups being located sequentially on said rotatable cover disk, a sequence of said sectors of said first and second radii in each of said at least second and third ones of said at least three said sector groups being different from a sequence of said sectors of said at least first and second radii in adjacent ones of said at least second and third ones of said at least three second sector groups on said rotatable cover disk.

2. The cylinder of claim 1 wherein said cylinder is operable in triple collating operation.

3. The cylinder of claim 1 wherein said cylinder is operable in quadruple collating operation.

4. The cylinder of claim 1 further including a compensating gear coupling said rotatable cover disk and said cylinder.

5. The cylinder of claim 4 wherein said compensating gear is one of a planetary gear and a harmonic drive gear.

6. The cylinder of claim 1 wherein each said second radius is greater than each said first radius.

7. The cylinder of claim 1 wherein said control arrangement includes a control lever supporting a first cam disk tracing roller and a second rotatable cover disk tracing roller.

8. The cylinder of claim 1 wherein said control arrangement includes a first control lever adapted to trace said cam disk and a second control lever adapted to trace said rotatable cover disk, said first and second control levers being pivotable about a common axis.

9. The cylinder of claim 1 wherein said groups of tools are selected from sheet grippers, spur needle strips, folding blades and folding jaws.

10. The cylinder of claim 9 wherein a single said rotatable cover disk controls said groups of tools.

11. The cylinder of claim 1 wherein each of said at least first and second groups of sectors determine a production mode of said cylinder in which said cylinder collates work pieces of said flat material.

12. The cylinder of claim 1 further including a folding blade cylinder, said folding blade cylinder driving said rotatable cover disk.

13. The cylinder of claim 1 further including ones of a gripper cylinder and a spur needle cylinder, said rotatable cover disk being driven by said one of said gripper cylinder and said spur needle cylinder.

14. The cylinder of claim 1 further including a folding jaw cylinder, said folding jaw cylinder driving said rotatable cover disk.

15. The cylinder of claim 1 wherein said rotatable cover disk is driven by a positionally-controlled electric motor.

16. The cylinder of claim 1 wherein said first sector group determines a non-collating operational mode.

17. The cylinder of claim 1 wherein said second sector group determines a single-collating operational mode.

18. The cylinder of claim 17 wherein in said single-collating operation, a group of folding blades is extended from said cylinder circumference once in two successive rotations of said cylinder.

19. The cylinder group of claim 1 wherein said a third sector group which determines a dual-collating mode.

20. The cylinder of claim 19 wherein in said dual-collating operation, a group of folding blades is extended from said cylinder circumference once in three successive rotations of said cylinder.

21. The cylinder group of claim 1 further including a fourth sector group which determines a triple collating mode.

22. The cylinder of claim 21 wherein in said triple collating operation, a group of folding blades is extended from said cylinder circumference once in four successive rotations of said cylinder.

23. The cylinder of claim 1 wherein there are five of said tools in said at least first group of tools.

24. The cylinder of claim 23 wherein said tools are folding blades.

25. The cylinder of claim 23 wherein said five tools are selected from spur needle systems and grippers.

26. The cylinder of claim 25 wherein a single said rotatable cover disk controls said groups of tools.

27. The cylinder of claim 1 wherein there are seven of said tools in said at least first group of tools.

28. The cylinder of claim 1 wherein seven folding blades are arranged on said cylinder circumference.

29. The cylinder of claim 1 wherein seven ones of spur needle systems and grippers are arranged on said cylinder circumference.

30. The cylinder of claim 29 wherein spacing distances between said spur needle systems and said grippers are unchangeable.

31. The cylinder of claim 1 further including at least four sector groups.

* * * * *